US010844577B2

(12) United States Patent
Kondo et al.

(10) Patent No.: US 10,844,577 B2
(45) Date of Patent: Nov. 24, 2020

(54) HYDRAULIC DRIVE SYSTEM OF CONSTRUCTION MACHINE

(71) Applicant: KAWASAKI JUKOGYO KABUSHIKI KAISHA, Kobe (JP)

(72) Inventors: Akihiro Kondo, Kobe (JP); Hideyasu Muraoka, Akashi (JP); Jun Umekawa, Akashi (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 16/330,186

(22) PCT Filed: Aug. 28, 2017

(86) PCT No.: PCT/JP2017/030742
§ 371 (c)(1),
(2) Date: Mar. 4, 2019

(87) PCT Pub. No.: WO2018/043401
PCT Pub. Date: Mar. 8, 2018

(65) Prior Publication Data

US 2019/0211531 A1 Jul. 11, 2019

(30) Foreign Application Priority Data

Sep. 2, 2016 (JP) ..... 2016-171402

(51) Int. Cl.
*E02F 9/22* (2006.01)
*F15B 11/00* (2006.01)
(Continued)

(52) U.S. Cl.
CPC ..... *E02F 9/2225* (2013.01); *E02F 9/20* (2013.01); *E02F 9/2004* (2013.01); *E02F 9/22* (2013.01);
(Continued)

(58) Field of Classification Search
CPC ... E02F 9/2225; E02F 9/20; E02F 9/22; E02F 9/2004; F15B 11/00; F15B 11/08
See application file for complete search history.

(56) References Cited

U.S. PATENT DOCUMENTS

2016/0040690 A1* 2/2016 Yudate ..... E02F 9/123 60/327

FOREIGN PATENT DOCUMENTS

JP H08-85974 A 4/1996
JP H08-177085 A 7/1996

OTHER PUBLICATIONS

Oct. 17, 2017 International Search Report issued in International Patent Application No. PCT/JP2017/030742.

* cited by examiner

*Primary Examiner* — F Daniel Lopez
*Assistant Examiner* — Daniel S Collins
(74) *Attorney, Agent, or Firm* — Oliff PLC

(57) ABSTRACT

A hydraulic actuator; a control valve that controls supply and discharge of hydraulic oil to and from the hydraulic actuator; a pilot operation valve connected to the operation valve by a pair of pilot lines; a proportional solenoid pressure-reducing valve provided on at least one of the pair of pilot lines; an operation detector that outputs an operation amount signal in accordance with an inclination angle of an operating lever of the pilot operation valve; and a controller that controls the proportional solenoid pressure-reducing valve such that, from immediately after a change amount per unit time in the operation amount signal outputted from the operation detector has decreased by a threshold value or more, a pilot port pressure of the control valve gradually decreases to zero due to communication of a secondary
(Continued)

pressure port and a tank port of the proportional solenoid pressure-reducing valve with each other.

9 Claims, 4 Drawing Sheets

(51) Int. Cl.

| | |
|---|---|
| ***E02F 9/20*** | (2006.01) |
| ***F15B 11/08*** | (2006.01) |
| ***F15B 13/043*** | (2006.01) |
| *B66C 23/00* | (2006.01) |

(52) U.S. Cl.
CPC ..... *E02F 9/2285* (2013.01); *F15B 11/00* (2013.01); *F15B 11/08* (2013.01); *F15B 13/0433* (2013.01); *B66C 23/54* (2013.01); *E02F 9/2296* (2013.01)

HYDRAULIC DRIVE SYSTEM OF CONSTRUCTION MACHINE

TECHNICAL FIELD

The present invention relates to a hydraulic drive system of a construction machine.

BACKGROUND ART

Construction machines, such as hydraulic excavators and hydraulic cranes, perform various work by means of a hydraulic drive system. For example, Patent Literature 1 discloses a hydraulic drive system 100 of a hydraulic excavator as shown in FIG. 5.

In the hydraulic drive system 100, a pilot line 130, which connects one pilot port 121 of a control valve 120 intended for a hydraulic actuator 110 to a pilot operation valve 140, is provided with a proportional solenoid pressure-reducing valve 131. The pilot line 130 is further provided with a check valve 132 positioned between the proportional solenoid pressure-reducing valve 131 and the pilot operation valve 140.

The hydraulic drive system 100 is configured to be able to suppress a stop shock of the hydraulic actuator 110 when the operating lever of the pilot operation valve 140 is rapidly returned to its neutral position. Specifically, the proportional solenoid pressure-reducing valve 131 is controlled such that, after the operating lever of the pilot operation valve 140 is rapidly returned to the neutral position, the pressure at the pilot port 121 of the control valve 120 is kept until a dead time elapses, and thereafter, the pressure at the pilot port 121 gradually decreases.

CITATION LIST

Patent Literature

PTL 1: Japanese Laid-Open Patent Application Publication No. H08-85974

SUMMARY OF INVENTION

Technical Problem

However, in a case where the proportional solenoid pressure-reducing valve 131 is controlled as disclosed in Patent Literature 1, after the operating lever is returned to the neutral position, the operating speed of the hydraulic actuator is kept until the dead time elapses. Therefore, the responsiveness of the hydraulic actuator when stopping is poor.

In view of the above, an object of the present invention is to provide a hydraulic drive system of a construction machine, the hydraulic drive system being excellent in terms of the responsiveness of a hydraulic actuator when stopping and being capable of suppressing a stop shock of the hydraulic actuator.

Solution to Problem

In order to solve the above-described problems, a hydraulic drive system of a construction machine according to the present invention includes: a hydraulic actuator; a control valve that controls supply and discharge of hydraulic oil to and from the hydraulic actuator, the control valve including a pair of pilot ports; a pilot operation valve connected to the pair of pilot ports by a pair of pilot lines, the pilot operation valve including an operating lever; a proportional solenoid pressure-reducing valve provided on at least one of the pair of pilot lines, the proportional solenoid pressure-reducing valve including a primary pressure port, a secondary pressure port, and a tank port; an operation detector that outputs an operation amount signal in accordance with an inclination angle of the operating lever; and a controller that controls the proportional solenoid pressure-reducing valve such that, from immediately after a change amount per unit time in the operation amount signal outputted from the operation detector has decreased by a threshold value or more, a pilot port pressure of the control valve gradually decreases to zero due to communication of the secondary pressure port and the tank port with each other.

According to the above configuration, when the change amount per unit time in the operation amount signal outputted from the operation detector has decreased by the threshold value or more, in other words, when the operating lever of the pilot operation valve is rapidly returned in a direction toward its neutral position, the pilot port pressure of the control valve gradually decreases to zero, which makes it possible to suppress a stop shock of the hydraulic actuator. Moreover, the controlling of the proportional solenoid pressure-reducing valve such that the pilot port pressure of the control valve gradually decreases is started immediately after the operating lever of the pilot operation valve is rapidly returned in the direction toward the neutral position. Therefore, the hydraulic actuator can be stopped with high responsiveness. Furthermore, when the operating lever of the pilot operation valve is rapidly returned in the direction toward the neutral position, the proportional solenoid pressure-reducing valve is controlled by the controller such that the secondary pressure port communicates not with the primary pressure port but with the tank port. Therefore, by utilizing relief operation (operation of keeping the secondary side pressure) at the time of reverse flow of the pressure-reducing valve, the hydraulic oil discharged from the pilot port of the control valve can be retained for a suitable length of time and smoothly returned to the tank without via the pilot operation valve.

Immediately after the change amount per unit time in the operation amount signal outputted from the operation detector has decreased by the threshold value or more, the controller may change a command current fed by the controller to the proportional solenoid pressure-reducing valve to a predetermined value to bring the secondary pressure port into communication with the tank port, and thereafter gradually increase or decrease the command current fed to the proportional solenoid pressure-reducing valve. According to this configuration, the secondary pressure port and the tank port of the proportional solenoid pressure-reducing valve communicate with each other in accordance with decrease in the pilot port pressure of the control valve, and the degree of opening of the communication between the secondary pressure port and the tank port can be kept small. This makes it possible to smoothly decrease the pilot port pressure to zero.

The above hydraulic drive system may further include a temperature sensor that detects a temperature of the hydraulic oil. The lower the temperature of the hydraulic oil detected by the temperature sensor, the more the controller may raise a speed at which to gradually increase or decrease the command current from the predetermined value. When the temperature of the hydraulic oil is low, the stop shock of the hydraulic actuator is less likely to occur since the viscosity of the hydraulic oil is high. Therefore, by raising the speed at which to increase or decrease the command current in accordance with decrease in the temperature of the hydraulic oil, the responsiveness when stopping in a case where the temperature of the hydraulic oil is low can be made faster.

No check valve may be provided on the pilot line between the pilot operation valve and the proportional solenoid pressure-reducing valve. According to this configuration, the absence of the check valve contributes to cost reduction.

The proportional solenoid pressure-reducing valve may be an inverse proportional valve whose secondary pressure and a command current indicate a negative correlation. The controller may set the command current fed by the controller to the proportional solenoid pressure-reducing valve to zero except during a period from immediately after the change amount per unit time in the operation amount signal outputted from the operation detector has decreased by the threshold value or more until a predetermined time elapses. According to this configuration, even when a failure of an electrical path (e.g., snapping of a cable) occurs, the control valve can be operated normally, and thus fail-safe is realized.

Advantageous Effects of Invention

The present invention makes it possible to provide a hydraulic drive system of a construction machine, the hydraulic drive system being excellent in terms of the responsiveness of a hydraulic actuator when stopping and being capable of suppressing a stop shock of the hydraulic actuator.

DESCRIPTION OF EMBODIMENTS

Figure 1:
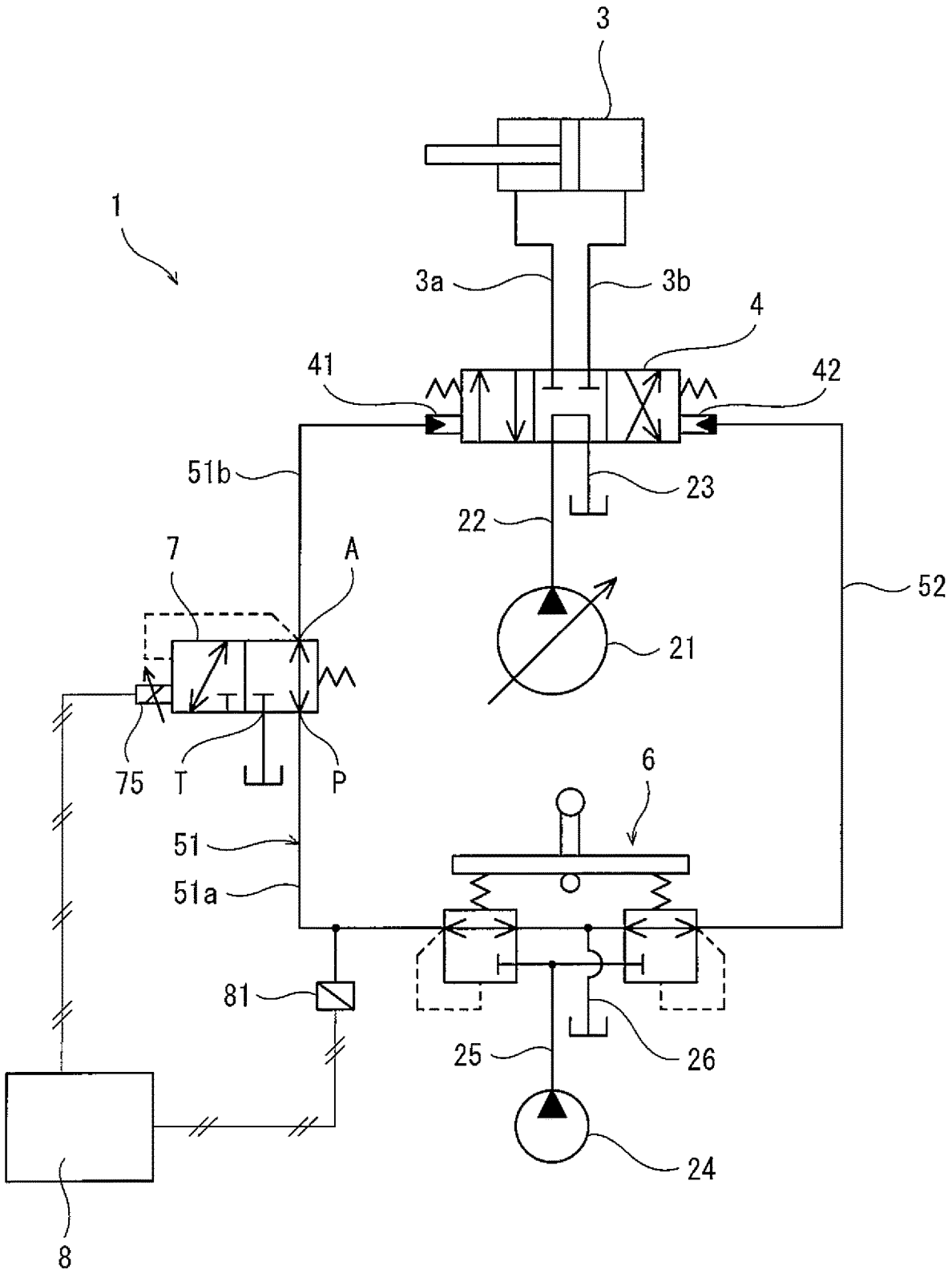
FIG. 1 shows a schematic configuration of a hydraulic drive system of a construction machine according to one embodiment of the present invention.

FIG. 1 shows a hydraulic drive system 1 of a construction machine according to one embodiment of the present invention. The hydraulic drive system 1 includes: a variable displacement main pump 21; and a hydraulic actuator 3, which is supplied with hydraulic oil from the main pump 21 via a control valve 4. Alternatively, the main pump 21 may be a fixed displacement pump.

For example, in a case where the construction machine is a self-propelled hydraulic excavator, the hydraulic actuator 3 may be any of the following: a boom cylinder; an arm cylinder; a bucket cylinder; a turning motor; and a running motor.

The control valve 4 is connected to the main pump 21 by a supply line 22 and to a tank by a tank line 23. The control valve 4 is also connected to the hydraulic actuator 3 by a pair of supply/discharge lines 3*a* and 3*b*. The control valve 4 controls supply and discharge of the hydraulic oil to and from the hydraulic actuator 3.

The control valve 4 includes a pair of pilot ports 41 and 42. These pilot ports 41 and 42 are connected to a pilot operation valve 6 by a pair of pilot lines that are a first pilot line 51 and a second pilot line 52.

The pilot operation valve 6 is connected to an auxiliary pump 24 by a primary pressure line 25 and to the tank by a tank line 26. The pilot operation valve 6 includes an operating lever, and outputs a pilot pressure in accordance with an inclination angle of the operating lever.

In the present embodiment, a proportional solenoid pressure-reducing valve 7 is provided on the first pilot line 51. Specifically, the first pilot line 51 includes: a first passage 51*a* between the pilot operation valve 6 and the proportional solenoid pressure-reducing valve 7; and a second passage 51*b* between the proportional solenoid pressure-reducing valve 7 and the pilot port 41 of the control valve 4. It should be noted that, as an alternative, the proportional solenoid pressure-reducing valve 7 may be provided not only on the first pilot line 51 but also on the second pilot line 52. As another alternative, the proportional solenoid pressure-reducing valve 7 may be provided only on the second pilot line 52.

In the present embodiment, no check valve is provided on the first pilot line 51 between the pilot operation valve 6 and the proportional solenoid pressure-reducing valve 7 (i.e., no check valve is provided on the first passage 51*a* of the first pilot line 51).

Figure 2:
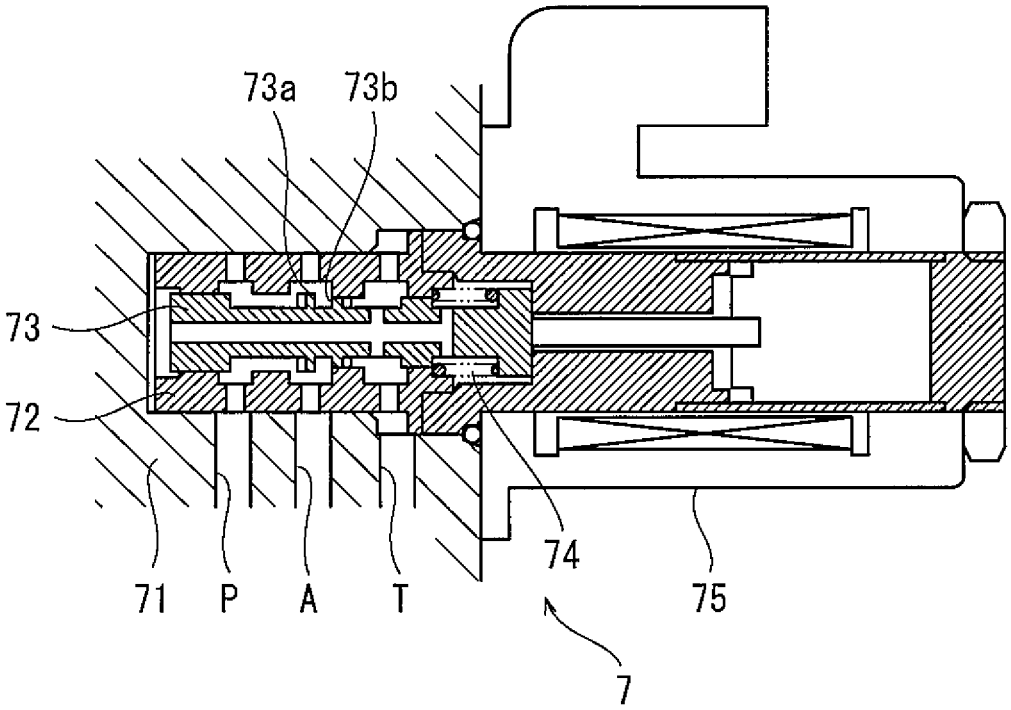
FIG. 2 is a sectional view of a proportional solenoid pressure-reducing valve.

The proportional solenoid pressure-reducing valve 7 includes a primary pressure port P, a secondary pressure port A, and a tank port T. Specifically, as shown in FIG. 2, the proportional solenoid pressure-reducing valve 7 includes: a housing 71, in which the primary pressure port P, the secondary pressure port A, and the tank port T are formed; a sleeve 72 disposed in the housing 71; and a spool 73 disposed in the sleeve 72. A plurality of through-holes are formed in the sleeve 72 at positions that correspond to the primary pressure port P, the secondary pressure port A, and the tank port T, respectively. The housing 71 is mounted with a solenoid 75 for pressing the spool 73. The tank port T is positioned at the solenoid 75 side when seen from the secondary pressure port A, and the primary pressure port P is positioned at the opposite side to the solenoid 75 when seen from the secondary pressure port A.

The spool 73 is urged by a spring 74 toward the solenoid 75. A first land 73*a* and a second land 73*b* are formed on the spool 73. The first land 73*a* opens/closes a first annular passage between the secondary pressure port A and the primary pressure port P (i.e., a gap between the spool 73 and the sleeve 72). The second land 73*b* opens/closes a second annular passage between the secondary pressure port A and the tank port T (i.e., a gap between the spool 73 and the sleeve 72). It should be noted that, on the outer peripheral surface of the spool 73, notches are formed at positions facing the respective annular passages (in the present embodiment, a notch is formed on one side surface of each of the lands 73*a* and 73*b* as shown in FIG. 2). Each notch is intended for preventing a sudden increase in the size of an opening. The external diameter of the first land 73*a* is greater than the external diameter of the second land 73*b*. Depending on the position of the spool 73, the secondary pressure port A is blocked from both the primary pressure port P and the tank port T, or communicates with either one of the primary pressure port P or the tank port T.

Figure 3:
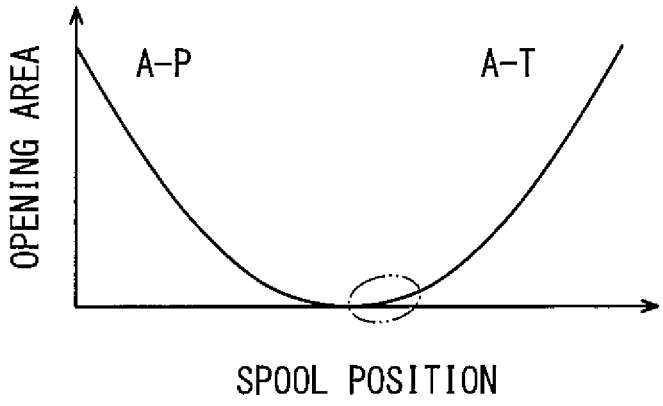
FIG. 3 is a graph showing a spool position and each opening area (the degree of communication between ports) of the proportional solenoid pressure-reducing valve.

In the present embodiment, the proportional solenoid pressure-reducing valve 7 may be an inverse proportional valve whose output secondary pressure and a command current indicate a negative correlation. When the command current fed to the solenoid 75 is zero, the proportional solenoid pressure-reducing valve 7 functions as a normal pressure reducing valve. Specifically, when the pressure at the primary pressure port P is zero, the spool 73 is kept by the spring 74 at the most retreated position. Accordingly, the secondary pressure port A communicates with the primary pressure port P, and the secondary pressure port A is blocked from the tank port T by the second land 73*b*. When the pressure at the primary pressure port P increases and thereby the pressure at the secondary pressure port A, which is in communication with the primary pressure port P, increases, the spool 73 is pressed by hydraulic force that results from the pressure of the secondary pressure port A being applied to a pressure receiving portion (i.e., an area difference between the first land 73*a* and the second land 73*b* shown in FIG. 2) of the spool 73, such that the spool 73 advances from the most retreated position to a pressure-adjusting position (at which an opening area P-A or an opening area A-T in FIG. 3 is close to zero).

On the other hand, when the command current fed to the solenoid 75 gradually increases, the thrust force of the solenoid 75 is applied against the spring 74. As a result, the force of the spring 74 is applied to the spool 73 in such a manner that, equivalently speaking, the force of the spring 74 is reduced. Consequently, as shown in FIG. 3, the opening area between the first land 73*a* and the sleeve 72 (i.e., the degree of communication between the secondary pressure port A and the primary pressure port P) gradually decreases, and the opening area between the second land 73*b* and the sleeve 72 (i.e., the degree of communication between the secondary pressure port A and the tank port T) gradually increases, which causes the pressure at the secondary pressure port A to decrease gradually such that, when the spool 73 is at the pressure-adjusting position, the pressure at the secondary pressure port A balances with the equivalent spring force (the difference between the urging force of the spring 74 and the thrust force of the solenoid 75).

Returning to FIG. 1, the proportional solenoid pressure-reducing valve 7 is controlled by a controller 8. Specifically, the controller 8 is electrically connected to the solenoid 75 of the proportional solenoid pressure-reducing valve 7. The controller 8 is also electrically connected to a pressure sensor 81. For example, the controller 8 includes a CPU and memories such as a ROM and RAM.

The pressure sensor 81 detects the pressure of the first passage 51*a* of the first pilot line 51 (i.e., the pilot pressure outputted from the pilot operation valve 6). That is, the pressure sensor 81 is an operation detector that outputs an operation amount signal in accordance with the inclination angle of the operating lever of the pilot operation valve 6.

Based on the operation amount signal outputted from the pressure sensor 81, the controller 8 determines whether or not the operating lever of the pilot operation valve 6 has been rapidly returned in a direction toward its neutral position (e.g., whether or not a cylinder speed has been reduced). Specifically, as shown in FIG. 4A, when a change amount per unit time ($\Delta P/\Delta t$ in FIG. 4A) in the operation amount signal (the detected pressure) outputted from the pressure sensor 81 has decreased by a threshold value or more, the controller 8 determines that the operating lever of the pilot operation valve 6 has been rapidly returned in the direction toward the neutral position (e.g., the cylinder speed has been reduced).

It should be noted that the operation detector may be an angle sensor that detects the inclination angle of the operating lever. In this case, when a change amount per unit time in the operation amount signal (the detected inclination angle of the operating lever) outputted from the angle sensor has decreased by a threshold value or more, the controller 8 determines that the operating lever of the pilot operation valve 6 has been rapidly returned in the direction toward the neutral position.

Figures 4A, 4B, 4C:
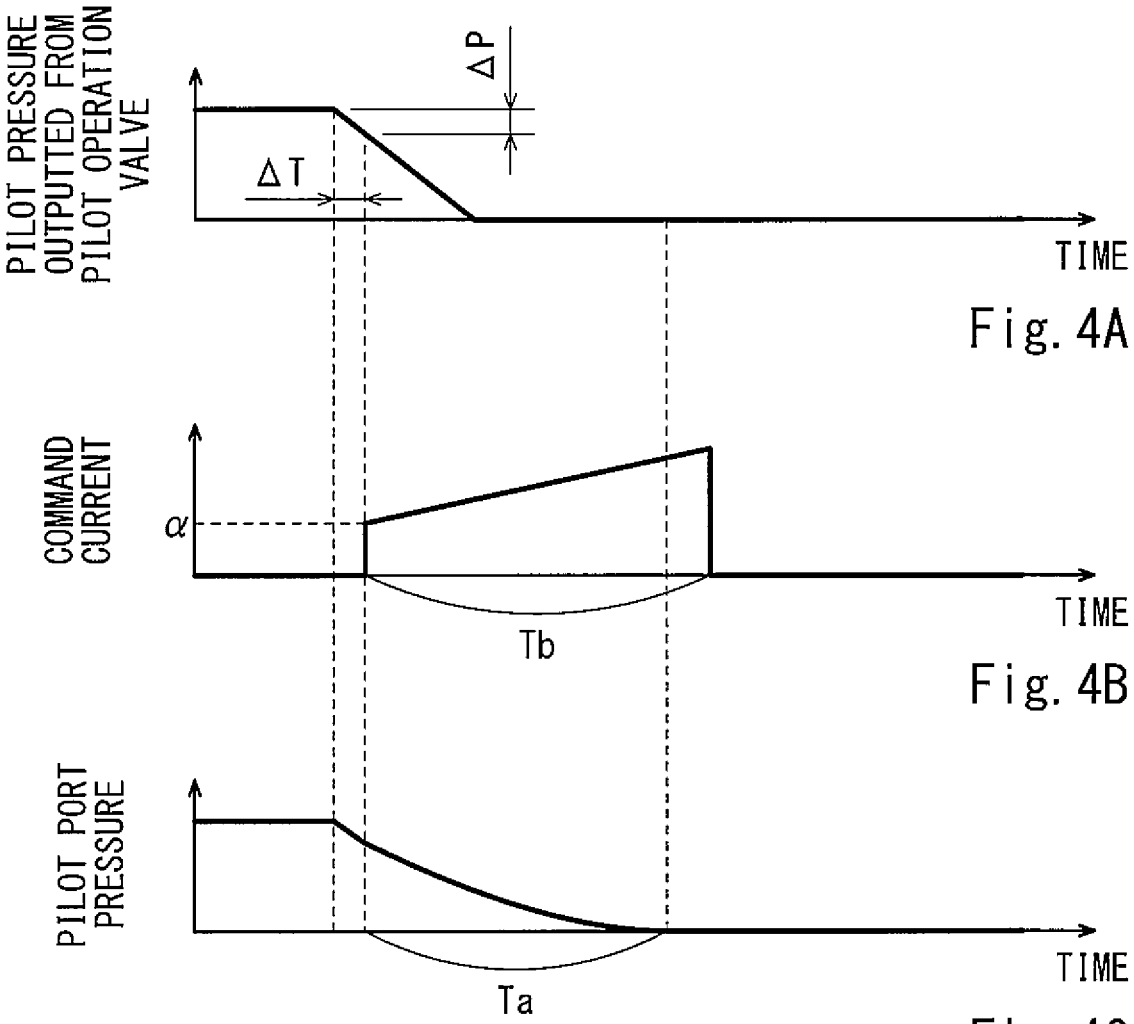
FIGS. 4A to 4C are graphs showing a pilot pressure outputted from a pilot operation valve, a command current fed to the proportional solenoid pressure-reducing valve, and temporal change in pilot port pressure, respectively, when an operating lever of the pilot operation valve is rapidly returned in a direction toward its neutral position.
Figure 5:
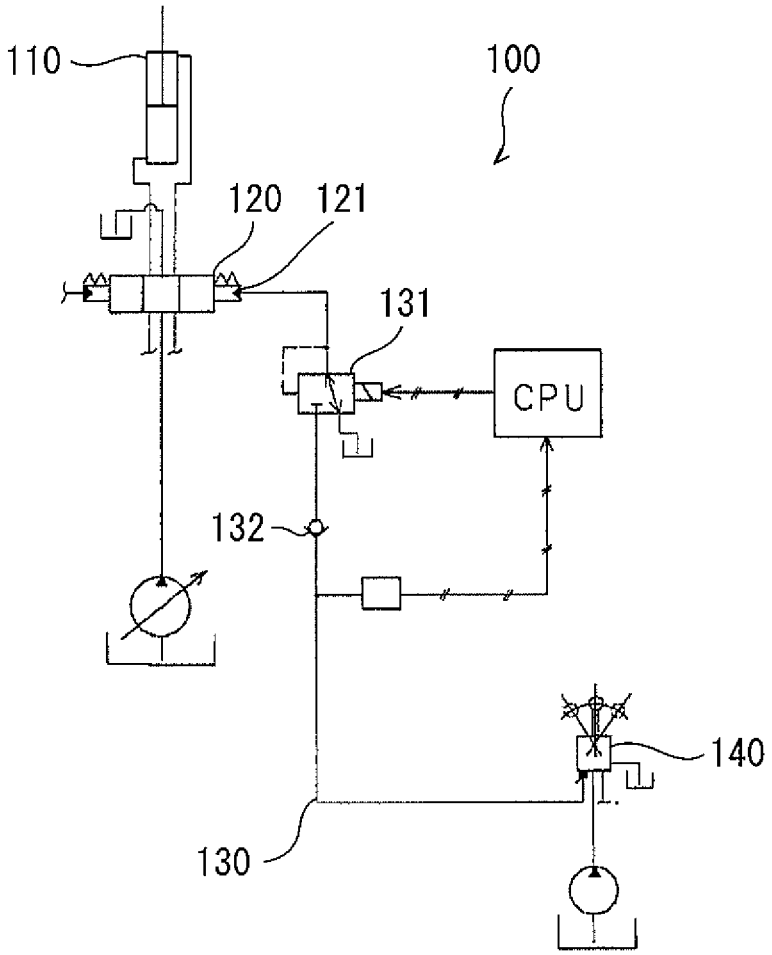
FIG. 5 shows a schematic configuration of a hydraulic drive system of a conventional hydraulic excavator.

As shown in FIG. 4B, the controller 8 sets the command current fed by the controller 8 to the proportional solenoid pressure-reducing valve 7 to zero except during a period from immediately after the change amount per unit time in the operation amount signal outputted from the pressure sensor 81 has decreased by the threshold value or more until a predetermined time Tb elapses.

Meanwhile, from immediately after the change amount per unit time in the operation amount signal outputted from the pressure sensor 81 has decreased by the threshold value or more, the controller 8 controls the proportional solenoid pressure-reducing valve 7 such that the pressure at the pilot port 41 of the control valve 4 gradually decreases to zero due to communication of the secondary pressure port A and the tank port T with each other by taking a certain amount of time Ta (see FIG. 4C). The certain amount of time Ta is, for example, 0.1 to 0.5 seconds. Here, the secondary pressure port A and the tank port T are brought into communication with each other within a range (indicated by two-dot chain line in FIG. 3) in which the opening area therebetween is small.

Specifically, immediately after the change amount per unit time in the operation amount signal outputted from the pressure sensor 81 has decreased by the threshold value or more, the controller 8 changes (increases) the command current fed to the proportional solenoid pressure-reducing valve 7 from zero to a predetermined value $\alpha$ to bring the secondary pressure port A of the proportional solenoid pressure-reducing valve 7 into communication with the tank port T. Thereafter, the controller 8 gradually increases the command current fed to the proportional solenoid pressure-reducing valve 7 by taking the predetermined time Tb, and when the predetermined time Tb has elapsed, sets the command current to zero again. The predetermined time Tb is, for example, 0.1 to 5 seconds.

As described above, in the hydraulic drive system 1 of the present embodiment, when the operating lever of the pilot operation valve 6 is rapidly returned in the direction toward the neutral position, the pressure at the pilot port 41 of the control valve 4 gradually decreases to zero. This makes it possible to suppress a stop shock of the hydraulic actuator 3. Moreover, the controlling of the proportional solenoid pressure-reducing valve 7 such that the pressure at the pilot port 41 of the control valve 4 gradually decreases is started immediately after the operating lever of the pilot operation valve 6 is rapidly returned in the direction toward the neutral position. Therefore, the hydraulic actuator 3 can be stopped with high responsiveness and with substantially no dead time. Furthermore, when the operating lever of the pilot operation valve 6 is rapidly returned in the direction toward the neutral position, the proportional solenoid pressure-reducing valve 7 is controlled by the controller 8 such that the secondary pressure port A communicates not with the primary pressure port P but with the tank port T. Therefore, by utilizing relief operation (operation of keeping the secondary side pressure) at the time of reverse flow of the pressure-reducing valve, the hydraulic oil discharged from the pilot port 41 of the control valve 4 can be retained for a suitable length of time and smoothly returned to the tank without via the pilot operation valve 6.

In the present embodiment, when the pressure at the pilot port 41 of the control valve 4 is decreased gradually, the command current fed by the controller 8 to the proportional solenoid pressure-reducing valve 7 is not a constant value, but increases gradually. Therefore, the secondary pressure port A and the tank port T of the proportional solenoid pressure-reducing valve 7 communicate with each other in accordance with the decrease in the pressure at the pilot port 41 of the control valve 4, and the degree of opening of the communication between the secondary pressure port A and the tank port T can be kept small. This makes it possible to smoothly decrease the pressure at the pilot port 41 to zero by taking a suitable time.

When the temperature of the hydraulic oil is low, the stop shock of the hydraulic actuator 3 is less likely to occur since the viscosity of the hydraulic oil is high. Therefore, the temperature of the hydraulic oil may be detected by a temperature sensor, and in accordance with the temperature of the hydraulic oil, the time over which the pressure at the pilot port 41 is decreased to zero may be adjusted. Specifically, the lower the temperature of the hydraulic oil detected by the temperature sensor, the more the controller 8 raises the speed at which to gradually increase the command current from the predetermined value $\alpha$. In this manner, in a case where the temperature of the hydraulic oil is low, the time over which the pressure at the pilot port 41 of the control valve 4 is decreased to zero can be shortened, and thereby the responsiveness when stopping can be made faster.

The first passage 51*a* of the first pilot line 51 may be provided with a check valve. However, if the first passage 51*a* is provided with no check valve as in the present embodiment, the absence of the check valve contributes to cost reduction.

(Variations)

The present invention is not limited to the above-described embodiment. Various modifications can be made without departing from the spirit of the present invention.

For example, the proportional solenoid pressure-reducing valve 7 may be a direct proportional valve whose output secondary pressure and the command current indicate a positive correlation. In this case, immediately after the change amount per unit time in the operation amount signal outputted from the pressure sensor 81 has decreased by the threshold value or more, the controller 8 changes (decreases) the command current fed to the proportional solenoid pressure-reducing valve 7 from the maximum value to a predetermined value $\beta$ to bring the secondary pressure port A of the proportional solenoid pressure-reducing valve 7 into communication with the tank port T. Thereafter, the controller 8 gradually decreases the command current fed to the proportional solenoid pressure-reducing valve 7. In this case, the controller 8 maximizes the command current fed to the proportional solenoid pressure-reducing valve 7 except during a period from immediately after the change amount per unit time in the operation amount signal outputted from the pressure sensor 81 has decreased by the threshold value or more until a predetermined time elapses. However, if the proportional solenoid pressure-reducing valve 7 is an inverse proportional valve as in the above-described embodiment, even when a failure of an electrical path (e.g., snapping of a cable) occurs, the control valve 4 can be operated normally, and thus fail-safe is realized.

Moreover, in the above case, similar to the previously described embodiment, the temperature of the hydraulic oil may be detected by a temperature sensor. The lower the temperature of the hydraulic oil detected by the temperature sensor, the more the controller 8 may raise the speed at which to gradually decrease the command current from the predetermined value $\beta$. In this manner, the responsiveness when stopping in a case where the temperature of the hydraulic oil is low can be made faster.

The structure of the proportional solenoid pressure-reducing valve 7 is not limited to the one shown in FIG. 2. Various structures are applicable to the proportional solenoid pressure-reducing valve 7.

REFERENCE SIGNS LIST

1 hydraulic drive system of a construction machine
3 hydraulic actuator
4 control valve
41, 42 pilot port
51, 52 pilot line
6 pilot operation valve
7 proportional solenoid pressure-reducing valve
P primary pressure port
A secondary pressure port
T tank port
8 controller
81 pressure sensor (operation detector)

The invention claimed is:

1. A hydraulic drive system of a construction machine, the hydraulic drive system comprising:

a hydraulic actuator;

a control valve that controls supply and discharge of hydraulic oil to and from the hydraulic actuator, the control valve including a pair of pilot ports;

a pilot operation valve connected to the pair of pilot ports by a pair of pilot lines, the pilot operation valve including an operating lever;

a proportional solenoid pressure-reducing valve provided on at least one of the pair of pilot lines, the proportional solenoid pressure-reducing valve including a primary pressure port, a secondary pressure port, and a tank port;

an operation detector that outputs an operation amount signal in accordance with an inclination angle of the operating lever; and a controller that controls the proportional solenoid pressure-reducing valve such that, from immediately after a change amount per unit time in the operation amount signal outputted from the operation detector has decreased by a threshold value or more, a pilot port pressure of the control valve gradually decreases to zero due to communication of the secondary pressure port and the tank port with each other, wherein immediately after the change amount per unit time in the operation amount signal outputted from the operation detector has decreased by the threshold value or more, the controller changes a command current fed by the controller to the proportional solenoid pressure-reducing valve to a predetermined value to bring the secondary pressure port into communication with the tank port, and thereafter gradually increases or decreases the command current fed to the proportional solenoid pressure-reducing valve.

2. The hydraulic drive system of a construction machine according to claim 1, further comprising a temperature sensor that detects a temperature of the hydraulic oil, wherein the lower the temperature of the hydraulic oil detected by the temperature sensor, the more the controller raises a speed at which to gradually increase or decrease the command current from the predetermined value.

3. The hydraulic drive system of a construction machine according to claim 2, wherein the proportional solenoid pressure-reducing valve is an inverse proportional valve whose secondary pressure and a command current indicate a negative correlation, and the controller sets the command current fed by the controller to the proportional solenoid pressure-reducing valve to zero except during a period from immediately after the change amount per unit time in the operation amount signal outputted from the operation detector has decreased by the threshold value or more until a predetermined time elapses.

4. The hydraulic drive system of a construction machine, according to claim 2, wherein no check valve is provided on the pilot line between the pilot operation valve and the proportional solenoid pressure-reducing valve.

5. The hydraulic drive system of a construction machine according to claim 4, wherein the proportional solenoid pressure-reducing valve is an inverse proportional valve whose secondary pressure and a command current indicate a negative correlation, and the controller sets the command current fed by the controller to the proportional solenoid pressure-reducing valve to zero except during a period from immediately after the change amount per unit time in the operation amount signal outputted from the operation detector has decreased by the threshold value or more until a predetermined time elapses.

6. The hydraulic drive system of a construction machine, according to claim 1, wherein no check valve is provided on the pilot line between the pilot operation valve and the proportional solenoid pressure-reducing valve.

7. The hydraulic drive system of a construction machine according to claim 6, wherein the proportional solenoid pressure-reducing valve is an inverse proportional valve whose secondary pressure and a command current indicate a negative correlation, and the controller sets the command current fed by the controller to the proportional solenoid pressure-reducing valve to zero except during a period from immediately after the change amount per unit time in the operation amount signal outputted from the operation detector has decreased by the threshold value or more until a predetermined time elapses.

8. The hydraulic drive system of a construction machine according to claim 1, wherein the proportional solenoid pressure-reducing valve is an inverse proportional valve whose secondary pressure and a command current indicate a negative correlation, and the controller sets the command current fed by the controller to the proportional solenoid pressure-reducing valve to zero except during a period from immediately after the change amount per unit time in the operation amount signal outputted from the operation detector has decreased by the threshold value or more until a predetermined time elapses.

9. A hydraulic drive system of a construction machine, the hydraulic drive system comprising:

a hydraulic actuator;

a control valve that controls supply and discharge of hydraulic oil to and from the hydraulic actuator, the control valve including a pair of pilot ports;

a pilot operation valve connected to the pair of pilot ports by a pair of pilot lines, the pilot operation valve including an operating lever;

a proportional solenoid pressure-reducing valve provided on at least one of the pair of pilot lines, the proportional solenoid pressure-reducing valve including a primary pressure port, a secondary pressure port, and a tank port;

an operation detector that outputs an operation amount signal in accordance with an inclination angle of the operating lever; and a controller that controls the proportional solenoid pressure-reducing valve such that, from immediately after a change amount per unit time in the operation amount signal outputted from the operation detector has decreased by a threshold value or more, a pilot port pressure of the control valve gradually decreases to zero due to communication of the secondary pressure port and the tank port with each other, wherein the proportional solenoid pressure-reducing valve is an inverse proportional valve whose secondary pressure and a command current indicate a negative correlation, and the controller sets the command current fed by the controller to the proportional solenoid pressure-reducing valve to zero except during a period from immediately after the change amount per unit time in the operation amount signal outputted from the operation detector has decreased by the threshold value or more until a predetermined time elapses.

* * * * *